US005190158A

United States Patent [19]

Remias

[11] Patent Number: 5,190,158

[45] Date of Patent: Mar. 2, 1993

[54] GOLD PAN WITH CLASSIFIER

[76] Inventor: Robert E. Remias, P.O. Box 1325, Ashland, Oreg. 97520

[21] Appl. No.: 790,553

[22] Filed: Nov. 12, 1991

[51] Int. Cl.[5] ..... B03B 5/00; B07B 1/00

[52] U.S. Cl. ..... 209/44; 209/417; 209/397; 209/447; 209/506; 294/55

[58] Field of Search ..... 209/44, 417, 418, 393, 209/397, 399, 370, 373, 409, 411, 447, 506; 294/55

[56] References Cited

U.S. PATENT DOCUMENTS

| | | | |
|---|---|---|---|
| 357,970 | 2/1887 | Toysley | 294/55 |
| 585,989 | 7/1897 | Sletcher | 209/447 |
| 1,966,359 | 7/1934 | Ryan | 209/447 |
| 3,106,419 | 10/1963 | Estwing | 294/55 |
| 4,162,969 | 7/1979 | Lagal | 209/447 |
| 4,289,241 | 9/1981 | Litrap | 209/44 |
| 4,400,269 | 8/1983 | Gordon | 209/447 |
| 4,671,868 | 6/1987 | Ottrok | 209/48 |

*Primary Examiner*—H. Grant Skaggs
*Attorney, Agent, or Firm*—Milton S. Gerstein

[57] ABSTRACT

The present invention is a gold pan with classifier which, when used in combination or independently thereof, provides a prospector with an apparatus that enhances metal recovery. The gold pan utilizes an elongated elliptical shape with inclined side walls of various heights with ribs and steps placed along at least a portion of each wall. The elliptical shape allowing a prospector to use the pan as a scoop or a catch basin. The classifier also employs an elongated elliptical or rectilinear shaped base which is operatively associated with the gold pan. In the middle of the classifier is a circular grid being concave and made of a cross hatched type screen wherein all parallel ridges are raised. The classifier sits on top of the gold pan in an interlocking fashion and can be used to shovel slurry into the classifier having a narrow undercut space to prevent slurry from entering the gold pan area directly but allowing water removal by titling the combination in any direction.

20 Claims, 5 Drawing Sheets

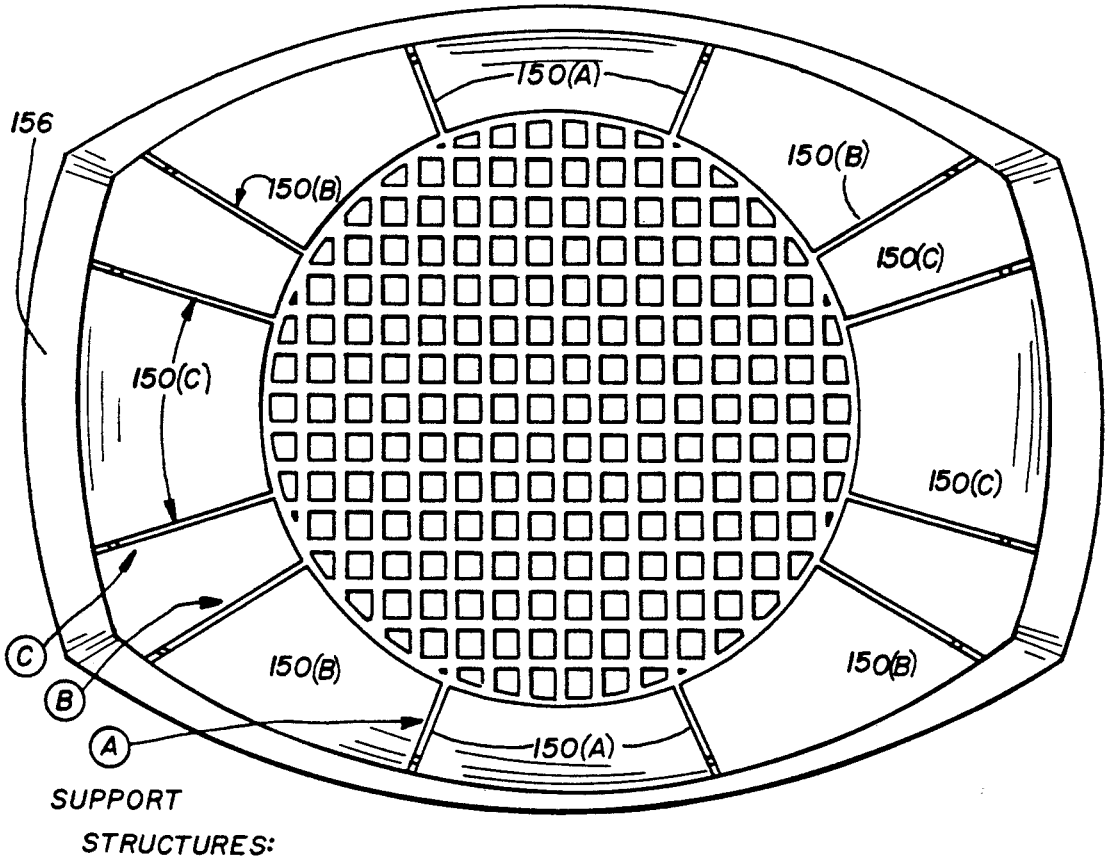
FIG. 9
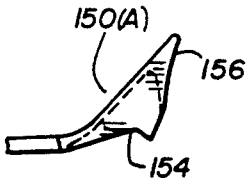
FIG. 10
FIG. 11
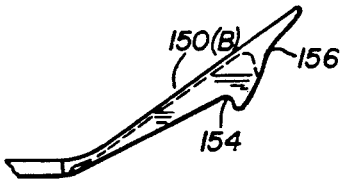
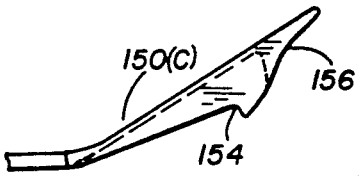
FIG. 12

GOLD PAN WITH CLASSIFIER

FIELD OF THE INVENTION

This invention relates generally to the recovery of precious metals, and more particular, to an apparatus that facilitates the removal of heavy metals such as gold from slurry basins.

BACKGROUND OF THE INVENTION

The use of a gold pan for removing precious metals from streams and river beds is well known. Prospectors have used the gold pan for over a century, most infamous being the prospectors of the great California gold rush. In reality, prospecting for gold is based upon a combination of luck and definitive scientific principles. Luck being self explanatory, scientific principles include the use of gravity for separation simplified by a circular "pan" to enhance the gravity separation process. Those prospectors astute to the principles of separating heavier matter from lighter matter were usually successful.

The use of the gold pan allowed the prospector create an abrasive environment for breaking up loosely bound solids as well as create a miniature cyclone effect to enhance separation. Typically, gold pans were made of metal having a concave central portion wherein a slurry of water and matter, such as the sand from the bottom of a river bed, would be placed and circulated along the inner surface of the pan. Normally, heavier matter settled to the bottom of the pan, however, unless the prospector knew to first remove larger matter, the separation would not occur as the larger matter would mask or entrap the precious metals. Further, even if larger matter was broken into smaller pieces, the prospector would need to circulate the slurry in a wobbling manner to dislodge the precious metals being careful not to allow precious metals to flow over a side of the pan with discarded slurry. Thus, the successful prospector acquired an exceptional skill to overcome the lack of technology.

Gradually gold pans were enhanced to assist in the separation process. The use of stepped indentations in the side of a pan created laminar areas giving heavier matter a location in which to settle. For instance, U.S. Pat. No. 4,162,969 issued Jul. 31, 1979 to Lagal illustrates an apparatus for separating material utilizing a round pan having a concave center portion and steps to assist in matter separation. However, while this gold pan assisted in the separation, its circular design exemplifies the problems associated with all prior art employing circular designs including: lack of a means for inducing agitation; inability to use a circular pan for scooping; inability to use a circular pan to trap falling matter; uniform side height prevents ease of matter removal; and the conventional gold pan does not have a means for incorporating a classifier U.S. Pat. No. 4,289,241 issued Sep. 15, 1981 to Litrap illustrates a rectangular gold pan used in combination with a classifier. Litrap's rectangular pan prevents use of the well known swirling technique and utilizes a flat classifier lacking a means to break up larger matter. Further, the classifier fails to allow the prospector from removing water while the classifier is attached.

Heretofore, no teaching is made of a gold pan that employs an elliptical shape having various wall sizes, employing both steps and ridges, and with which a classifier is operatively associated with the gold pan.

The present invention is directed to a gold pan with classifier that overcomes the shortcomings and problems associated with the prior art. It is, therefore, to the effective resolution of these shortcomings problems that the gold pan with classifier of the instant invention is directed.

SUMMARY OF THE INVENTION

It is the principal feature of the present invention to provide an apparatus that overcomes the shortcomings and associated problems described above by providing gold pan with classifier which, when used in combination or independently thereof, provides a prospector with an improved means for recovery of precious metals.

Generally the apparatus can be described as a lower gravity separation or "gold pan", and an upper filtration or "classifier pan". The gold pan has an elongated elliptical shape with inclined side walls. In the middle of the gold pan is a circular bottom or bottom wall from which the side walls extend upwardly and outwardly therefrom. The bottom includes a raised indentation or "step" encompassing the bottom creating an inspection area for use in final separating. End walls have a height larger than the height from the bottom wall to either side wall. The edges are of sharp design to aid in digging.

Along the interior of the gold pan is placed a plurality, or preferably three, transversely extending ribs which project into the interior. The rib closest to the circular bottom is approximately half the size as the upper two ribs, which upper two ribs are of the same size, allowing the prospector to vigorously shake the pan wherein the ridges help prevent matter from spilling over either end allowing faster separation of solidified matter that might otherwise be discarded, and also to create a calm or non-turbulent zone or area over the bottom circular area. Gold and other metals being of the weight they are, especially in relation to the other material, settle out quickly in the calm zone. Along a side wall is placed steps overlapping at least a portion of said ribs. These steps create a laminar flow as matter is run over the steps to help prevent heavy metals from being discarded during the rinsing process.

The upper pan or classifier also employs an elongated elliptical shaped base which is operatively associated with the gold pan. The classifier pan has inclined side walls with an elliptical grid bottom from which the side walls extend upwardly and outwardly therefrom. The grid being slightly concave utilizes a sloping edge for making the transition from the walls of the classifier to the grid preventing matter from collecting along the edge thereof. The grid itself is formed into a cross hatched screen wherein all parallel strips are raised in a singular direction. In accordance with the elliptical shape of the gold pan, the classifier pan includes end walls having a height from the bottom grid to the highest edge of the end wall which is larger than a height which comprises the height from the grid to either side wall. Each end having the outwardly sloping with raised sides as viewed from profile to form each end into a shovel like shape. The sloping edge designed to be comfortable to hold. Also, the trailing edge is swept back to aid in digging.

The classifier sits on top of the gold pan in an interlocking fashion and can be used to shovel slurry into the classifier while preventing slurry from entering the gold pan area directly. By titling the classifier and gold pan to any direction allows water to escape from the gold pan. Typically the classifier is used as a stationary type filter wherein slurry is placed onto the grid and filtered through the grid for selection of matter that is small which will not agitate the separation process. The filtered matter drops into the gold pan where water is added to the pan and the pan swirled, hit, or otherwise agitated to break up lighter matter such as mud. The object being removal of lighter matter leaving the heavier matter in the pan. Water can be added at any step to help the separation process.

The gold pan can be used without the classifier allowing the prospector to dig with the pan as can be done with the classifier/gold pan combination. Similarly, a first and second side of the gold pan utilizes sloping sidewalls to allow ease of material removal.

Therefore, it is an object of the instant invention to provide an apparatus that provides an enhanced agitation technique by use of an elliptical design wherein ridges are placed thereon to help prevent excess spillage yet allow the swirling technique.

Yet another object of the instant invention is the use of an elliptical classifier that is operatively associated with the gold pan allowing water to escape from the gold pan without removal of the classifier.

Still another object is to provide steps incorporated with ridges for multiple function thereof.

Another object of the instant invention is the use of a classifier having a slightly concave grid with raised grid lines in a parallel fashion and a sloping edge formed along the grid to the side wall to prevent matter from collecting along the edge of the grid.

Yet another object is to provide walls of various heights for ease of matter removal.

Yet still another object is to provide a gold pan with classifier having form fit to the human hand.

Another object is provided by a trailing edge which swept back to better enhance the ease of digging, with as little obstruction as possible.

Other and further objects, features, and advantages of the invention will become evident upon the reading of the following specification taken in conjunction with the drawing.

BRIEF DESCRIPTION OF THE DRAWINGS

The invention will be more readily understood with reference to the accompanying drawings, wherein:

FIG. 9 is a bottom view of the upper filter "classifier" illustrating the grid and support structure;

FIG. 10 is a cross sectional side view of a first (a) support structure of the classifier shown in FIG. 9;

FIG. 11 is a cross sectional side view of a second (b) support structure of the classifier shown in FIG. 9; FIG. 12 is a cross sectional side view of a third (c) support structure of the classifier shown in FIG. 9;

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure. The aims and objects of the invention are accomplished by providing a device that effectively removes excess carbon deposits on a valve.

Figure 1:
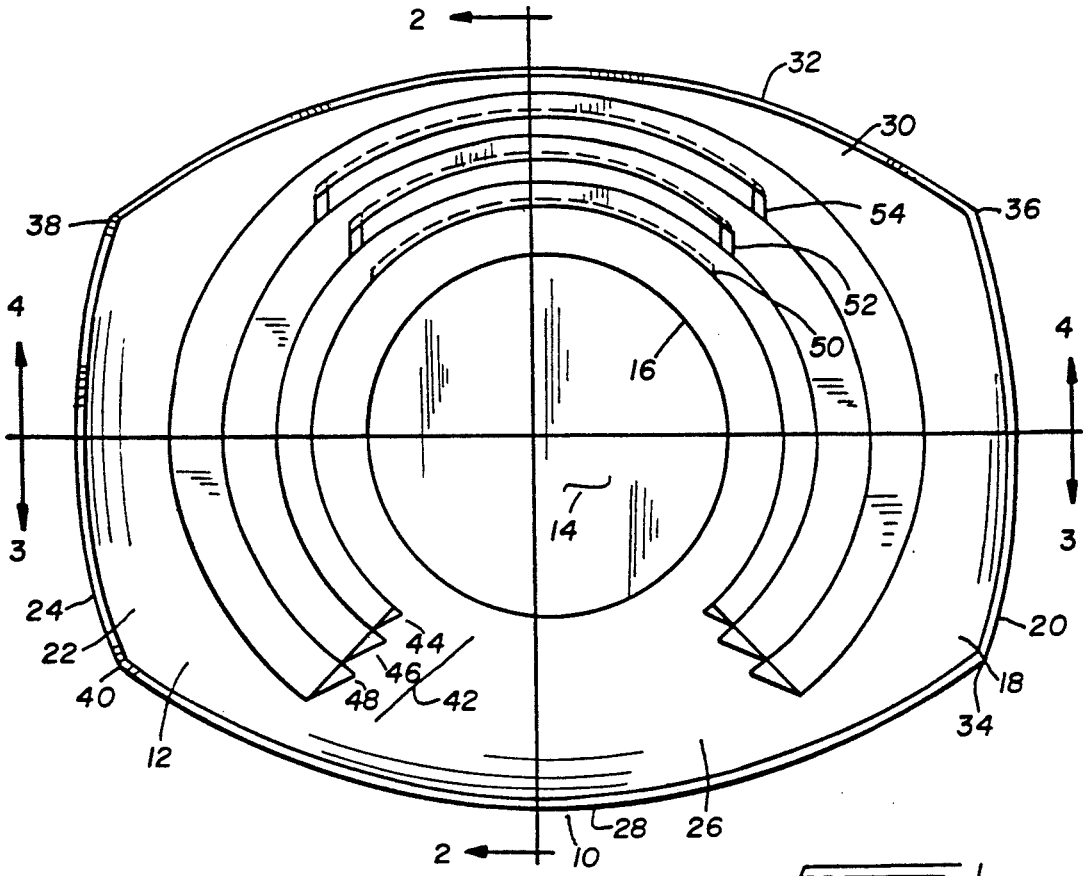
FIG. 1 is a top view of the lower gravity separation "gold pan" illustrating the steps and ridges.

Referring to the drawings in more detail, and more particularly to FIG. 1, there is shown a top view of the preferred embodiment of my gold pan 10 having an elongated elliptical shape with inclined side walls 12 made of plastic, metal, or the like formable substance. In the middle of the gold pan is a circular bottom or bottom wall 14 from which side walls 12 extend upwardly and outwardly therefrom. The bottom includes a raised indentation or "step" 16 encompassing the bottom of the pan 14 creating an inspection area.

From this view it is noted that the gold pan's 10 elliptical shape creates an elongated portion forming a first end wall 18 with a first, sharp end wall upper edge 20, a second end wall 22 with a second, sharp end wall upper edge 24. First end wall 18 is a mirror image of second end wall 22. Accordingly the shape creates a first side wall 26 with a first, sharp side wall upper edge 28, and a second side wall 30 with a second, sharp side wall upper edge 32. The first end wall 18 and the second end wall 22 having a height from the bottom wall edge 16 to the upper edge 20 and 24 respectfully is larger than a second height which comprises the height from the bottom wall 16 to the upper edge of either the first side wall 26 to upper edge 28 or the second side wall 30 to upper edge 32. The first end wall 18 having an upper width as measured from first corner 34 to second corner 36 equal to the width of the second end wall 22 having an upper width as measured from third corner 38 to fourth corner 40. The first side wall 26 having an upper width as measured from the first corner 34 to the fourth corner 40 equal to the width of the second end wall 30 having an upper width as measured from the second corner 36 to the third corner 38. The upper width of either side wall is greater than the upper width of either end wall. The gold pan's elliptical shape allows the prospector to dig or scoop up material using either the first end wall 18 or the second end wall 22, or by using the first side wall 26 or the second side wall 30 by dragging the pan against material (toward the user, for example); conversely, the upper edge width of either side wall 26, 30 allows placement against a substantially flat surface such as a river bank for catching matter. End walls 18, 22 may also be employed when the user is confronted with a confining or restricting area ( of a river bank, for example).

Along the interior of the gold pan is placed a plurality, or preferably three, transversely extending ribs 42 which project into the interior. These ribs create an area of turbulence as matter is passed over the ribs forming an induced abrasive action for dislodging matter trapped within, and for causing gold to settle out in the calm or non-turbulent area or zone (bottom wall 14). The ribs encompass the surface of a portion of the first side wall 26 and extending around the pan parallel to the bottom edge wall 16 ending on the opposite portion of the originating pan wall 26. The lowest rib is of a different size than the upper two ribs, the lower rib 44 closest to the bottom wall 14 having a size approximately half that of the second, or middle ridge 46, and the third, or upper ridge 48. The ridges on either end wall 18, 22 allow the prospector to vigorously shake the matter as the ridges prevent matter from spilling over either end 20, 24. This allows a faster separation of material and means for separating solidified matter that might otherwise be discarded, and for causing gold to settle out in the calm or non-turbulent area or zone side (bottom wall 14).

Along the second side wall 30 is placed a plurality, or preferably three, transversely placed steps overlapping at least a portion of said ribs. Each step is of the same size, and are spaced equally apart from one another, and form spaces therebetween, which spaces aid in trapping gold during the rinsing process.

Figure 2:
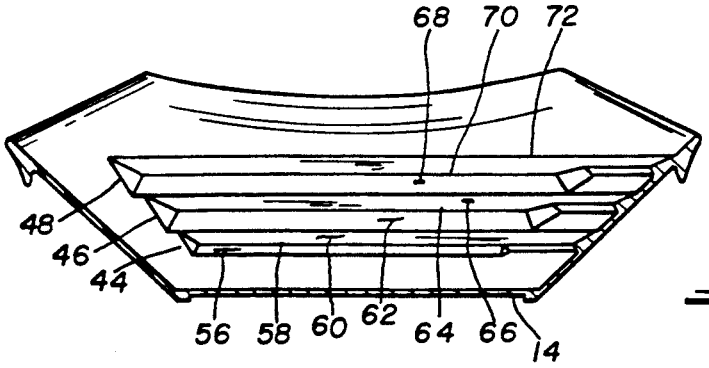
FIG. 2 is a cross sectional end view taken along A—A shown in FIG. 1.

Now referring to FIG. 2, which is a cross sectional end view taken along A—A shown in FIG. 1 illustrating the ridges. The lower ridge 44 has a flat frontal side 56 that is substantially perpendicular to bottom 14 leading to edge 58 extending obliquely upwardly along the wall before to juncture 60. The middle ridge 46 has a flat frontal side 62 that is substantially perpendicular to bottom 14 leading to edge 64 extending obliquely upwardly along the wall before returning to the wall at juncture 66. Middle ridge 46 frontal side 62 being approximately twice as large as the lower ridge 44 frontal side 56. The upper ridge 48 has a flat frontal side 68 that is substantially perpendicular to bottom 14 leading to edge 70 extending obliquely upwardly along the wall before returning to juncture 72. Upper ridge 48 frontal side 68 being the same size as the middle ridge 46 frontal side 62. By placement of ridge frontal walls 56, 62, and 68 perpendicular to the bottom wall, the gold pan 10 will allow matter to flow over the ridges as opposed to a perpendicular stance to the side wall which would act as a stop.

Figure 3:
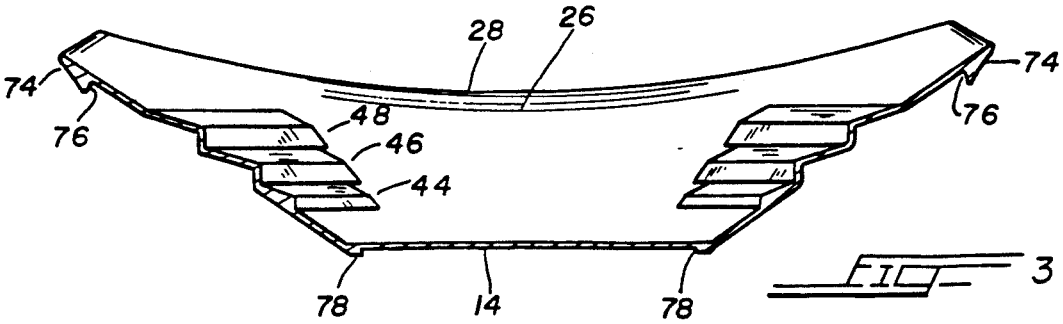
FIG. 3 is a cross sectional side view taken along B—B shown in FIG. 1.

Referring to FIG. 3 which is a cross sectional side view taken along B—B shown in FIG. 1, the end of the three ridges can be seen along first side wall 26 having shortened height to upper edge 28 wherein matter is allowed to flow out of the pan without obstruction.

Flare 74 is shown as provided around the circumference of the pan having a lip 76 allowing the prospector to grasp and maintaining a hold on the pan with minimal effort even when wet. Raised edge 78 encompassing the outer circumference of the bottom wall 14 provides an additional hand hold.

Figure 4:
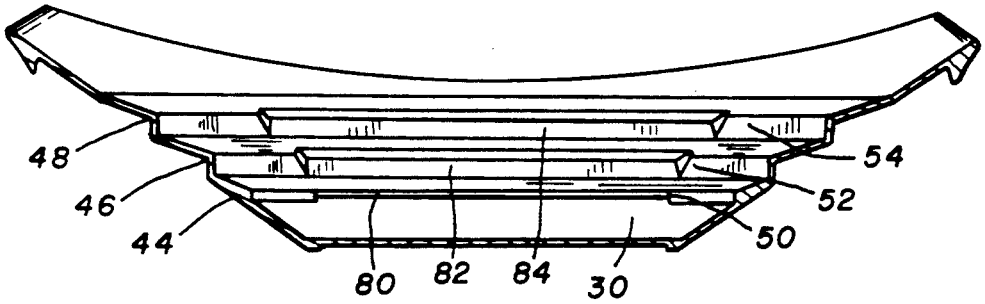
FIG. 4 is a cross sectional side view taken along C—C shown in FIG. 1.

FIG. 4 is a cross sectional side view taken along C—C as shown in FIG. 1 wherein lower step 50 having a frontal surface 80 perpendicular to wall 30 is formed directly into lower ridge 44. Middle step 52 is placed over middle ridge 46 having a frontal surface 82 the same size as lower step frontal surface 80 also perpendicular to wall 30. Upper step 54 is shown placed over upper ridge 48 having a frontal surface 84 the same size as middle step frontal surface 82 also perpendicular to wall 30. The steps create a laminar flow area for slurry when the pan is titled allowing slurry or water to flow out of the pan by use of side 30. The perpendicular walls are designed to allow water and lighter materials to flow over the frontal surfaces 80, 82, and 84 while stopping the loss of heavier material such as the metals, while the spaces between the steps are instrumental in creating a trap-area, or trough, during the rinsing process.

Figure 5:
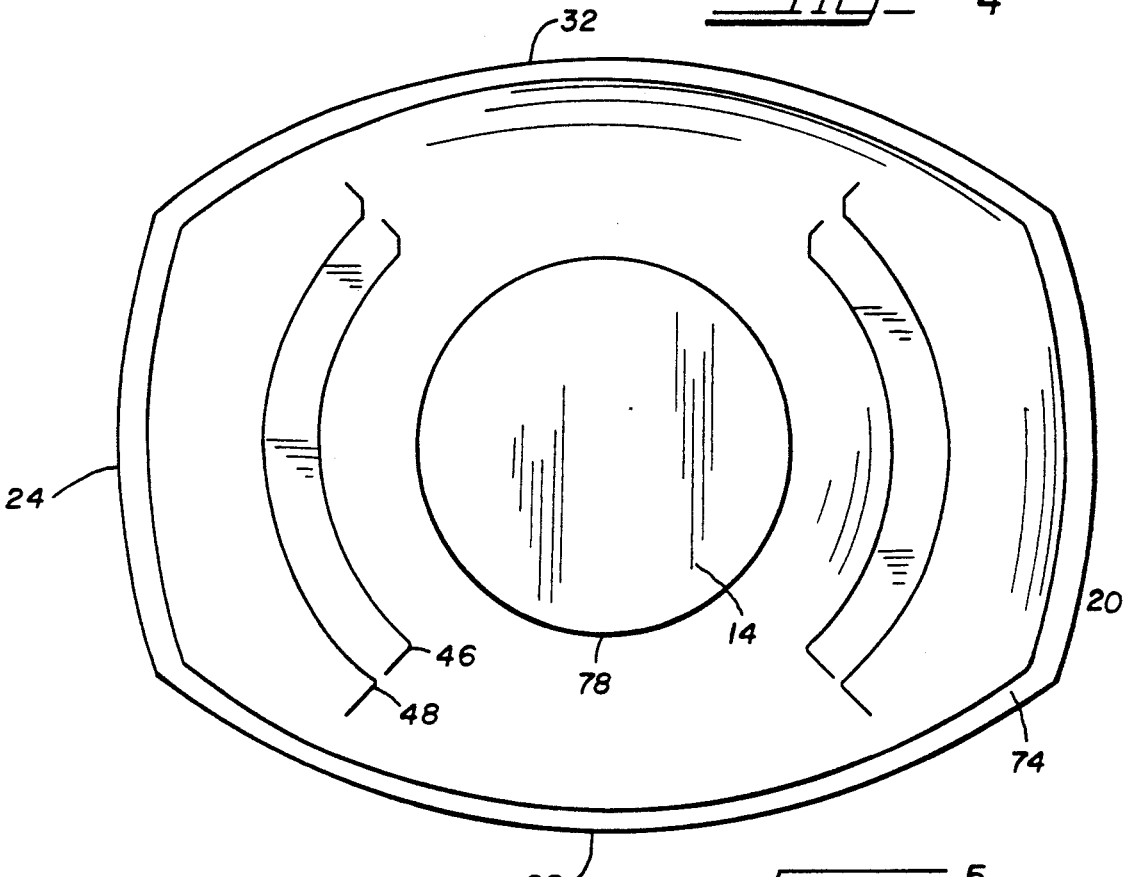
FIG. 5 is a bottom view of the lower gravity separation "gold pan" illustrating the ridges.

FIG. 5 is a bottom view of the gold pan for illustration of the circular bottom 14 encompassed by raised ridge 78 and pan edges 20, 24, 28, and 32 encompassed by flare 74 for providing a hand-hold as previously mentioned. The indentions of the middle ridge 46 and upper ridge 48 are shown as manufactured.

Figure 6:
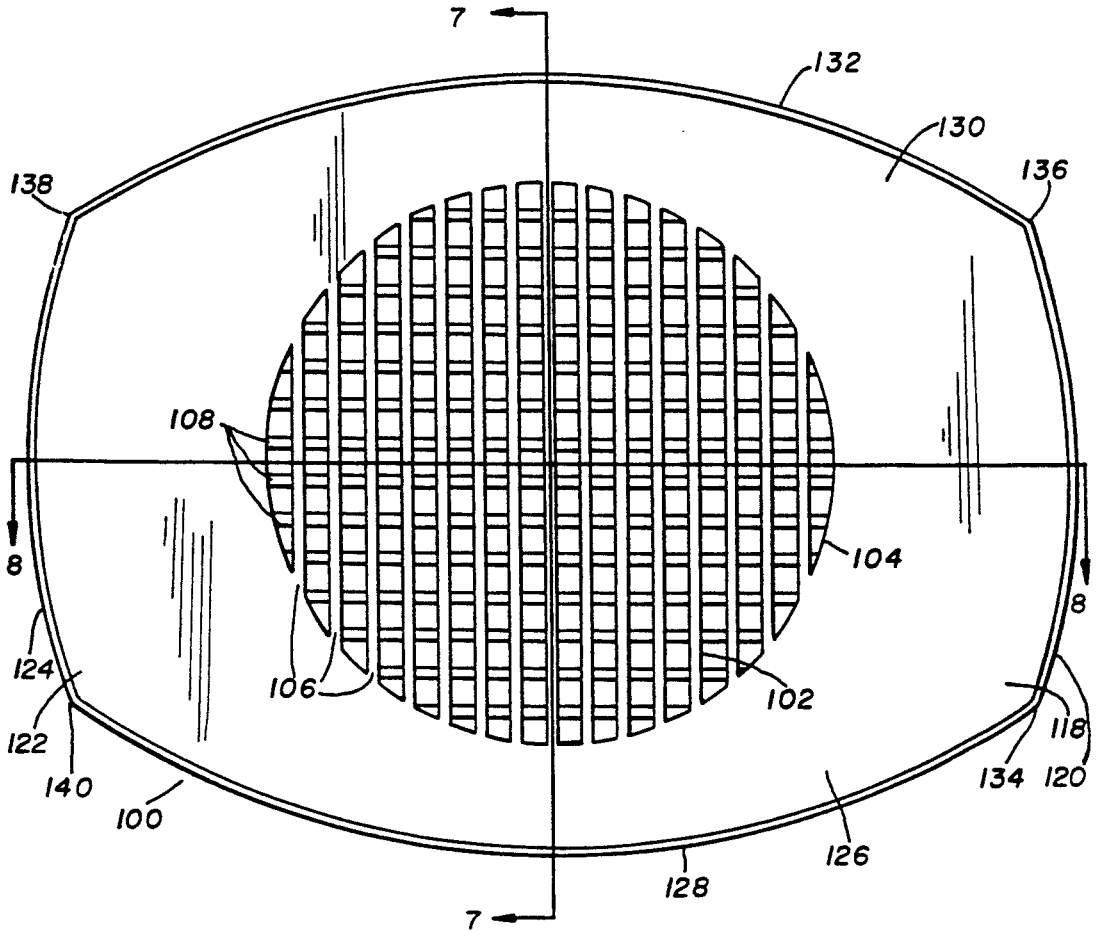
FIG. 6 is a top view of the upper filter "classifier" illustrating the grid.

Now referring to FIG. 6, a top view of the upper filter or "classifier" is shown having an elongated elliptical shape and inclined side walls, made of plastic, metal, or the like formable substance. In the middle of the classifier is an elliptical bottom or grid 102 from which the walls extend upwardly and outwardly in a similar fashion as the gold pan. The grid 102 being slightly concave (with material having more of a tendency to drift to the center) utilizes a sloping edge 104 for making the transition to the walls to prevent matter from collecting along the edge of the grid 102. The grid 102 itself is made of a cross hatched type screen having parallel raised ridges 106 over perpendicular placed parallel subdued ridges 108. In this manner the screen is multi-function wherein the grid 102 can be used to filter matter by distribution between the subdued ridges 108 or to physically break up larger material by rubbing the material against the raised ridges 106.

From this view it is noted that the classifier's 100 elliptical shape creates an elongated portion forming a first end wall 118 with a first, sharp end wall upper edge 120, and a second end wall 122 with a second, sharp end wall upper edge 124. First end wall 118 is a mirror image of second end wall 122. Accordingly the shape creates a first side wall 126 with a first, sharp side wall upper edge 128 and a second side wall 130 with a second, sharp side wall upper edge 132, the first side wall a mirror image of the second sidewall. The first end wall 118 and the second end wall 122 having a height from the grid 102 to the upper edge 120 and 124 respectfully which is larger than a second height which comprises the height from the grid 102 to the upper edge of either the first side wall 126 to upper edge 128 or the second side wall 130 to upper edge 132. The first end wall 118 having an upper width as measured from first corner 134 to second corner 136 equal to the width of the second end wall 122 having an upper width as measured from third corner 138 to fourth corner 140. The first side wall 126 having an upper width as measured from the first corner 134 to the fourth corner 140 equal to the width of the second end wall 130 having an upper width as measured from the second end wall 136 to the third corner 138. The upper width of either side wall is greater than the upper width of either end wall. In a similar fashion as the gold pan 10, the classifier's 100 elliptical shape allows the prospector to dig or scoop up material using either the first end wall 118 or the second 122. Side walls may also be used, as in dragging classifier/gold pan unit toward user with the side wall edge against material, for example. Conversely, the upper edge width of either side wall 126, 130 allows placement against a substantially flat surface such as a river bank to catch falling material.

Figure 7:
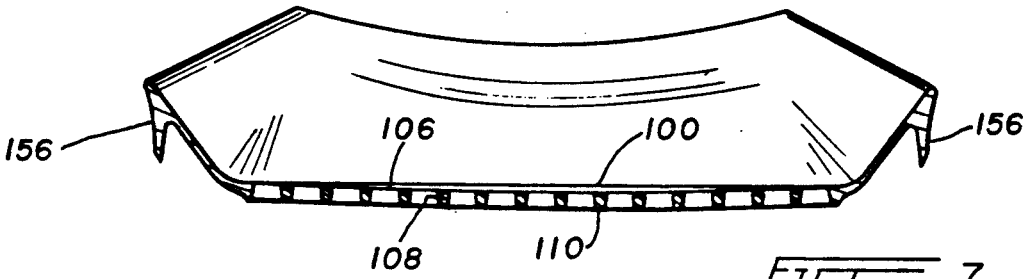
FIG. 7 is a cross sectional end view taken along D—D shown in FIG. 6.

FIG. 7 is a cross sectional end view taken along D—D shown in FIG. 6 wherein the grid 102 is shown having a slightly concave center. The cross hatched type screen having parallel raised ridges 106 over perpendicular placed ridges 108 can be seen in this view. Further, individual ridges 110 have a tapered contour wherein the upper portion of the ridge is larger than the lower portion thereby preventing the clogging of the screen as matter capable of fitting thought the upper portion will filter through without further obstruction.

Figure 8:
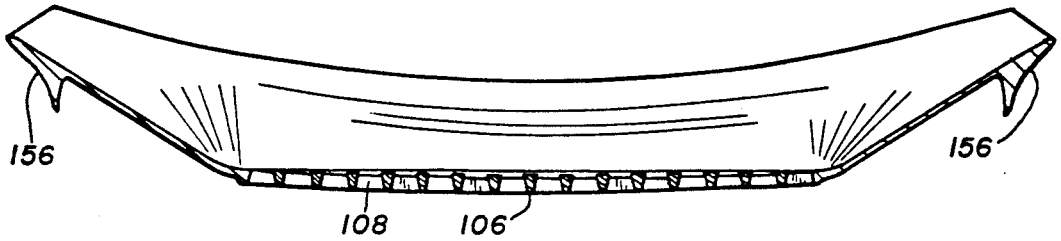
FIG. 8 is a cross sectional side view taken along E—E shown in FIG. 6.

FIG. 8 is a cross sectional side view taken along E—E shown in FIG. 6 further illustrating the difference between raised ridge 106 and subdued ridge 108. Now referring to FIGS. 9, 10, 11 and 12, the support structures clearly demonstrates support locations encompassing the lower portion of the classifier. Each support structure 150(*a*), 150(*b*), 150(*c*) constitutes a flare having a lip 154 which is used to maintain the classifier 100 a fixed distance and in position above the gold pan 10.

Figure 13:
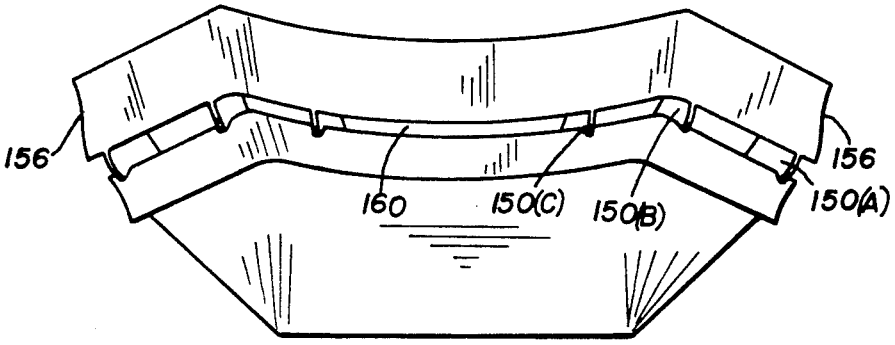
FIG. 13 is an end view of the gold pan and classified associated therewith.
Figure 14:
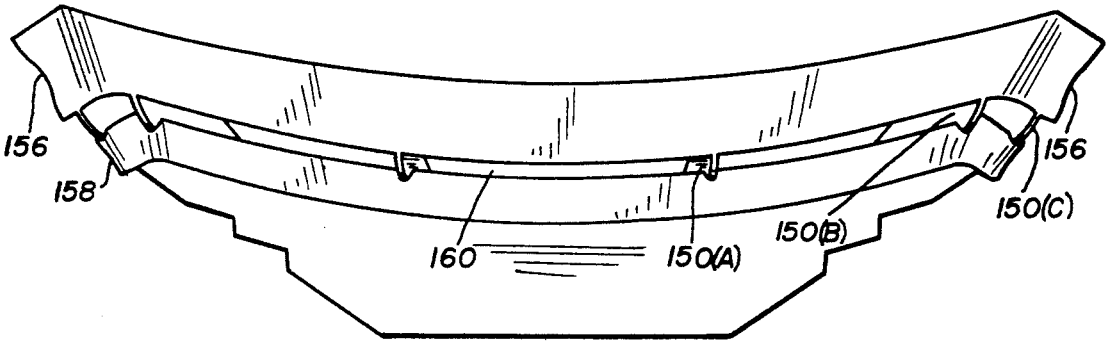
FIG. 14 is a side view of the gold pan and classified associated therewith.

FIGS. 13, 14 are end and side views, respectively, of the gold pan and classifier associated therewith. The classifier 100 sits on top of the gold pan 10 in an interlocking fashion and can be used to shovel a slurry into the classifier having beveled classifier 156 on the entire circumference to prevent slurry from entering the gold pan area directly, the gold pan 158 having an inner surface of less circumference than the classifier. By titling the classifier and gold pan in any direction allows water to escape from space 160 provided by separation from support structures 150. Typically the classifier is used as a preliminary type filter wherein slurry is placed onto the grid and filtered through the grid for breaking up large material into smaller matter. The filtered matter drops into the gold pan where water is added to the pan and the pan swirled, hit, or otherwise agitate to break up lighter matter such as mud with the object being the lighter matter be removed slowly so that the heavier matter will remain in the pan. Water can be added at any step to help the separation process.

The elliptical shape of the upper classifier and lower pan also allows a greater surface area for collection of matter when used to catch material dislodged from the side of a river bank. For instance if a prospector utilizes a circular pan, matter dislodged from the river bank must fall within an area less than an inch wide else be loss by missing the pan. The instant invention prevents loss of the matter by providing large usable side edge nearly the length of the pan that can be placed against the river bank. Also, when the space is restricted, the end walls can be used in the same manner.

The gold pan can be used without the classifier, the elongated elliptical base allows the prospector to dig into a slurry as can be done with the classifier/gold pan combination. Similarly, a first and second side of the gold pan utilize sloping sidewalls allow ease of removal of excess material.

It will be apparent that modifications in accordance with the present invention can be made by those skilled in the art without departing from the spirit thereof and it is equally apparent that the apparatus can be of a variety of sizes having the above described functionality. It will be obvious to those skilled in the art that various changes may be made without departing from the scope of the invention and the invention is not to be considered limited to what is shown in the drawings and described in the specification. Also, ridge 44 reduces turbulance near bottom wall 14, and ridge 44 in combination with step 50 create a contiguous ridge that acts as a trap around bottom wall 14.

What I claim and desire to secure by Letters Patent of the United States is:

1. An apparatus for separating particulate matter of disparate specific gravities from a carrier fluid comprising; a lower gravitational pan and an upper filtration pan, said lower pan having an elongated elliptical shape having two inclined end walls, a first and second pan inclined side wall, and a horizontally, centrally located bottom wall, said first and second inclined walls extending upwardly and outwardly from said bottom wall to a first height, said end walls extending obliquely upwardly and outwardly from said bottom wall to a second height, each said wall having an interior and exterior surface, a plurality of transversely extending ridges projecting from the interior surface of a first portion of said first side wall and encompassing said second side wall and both ends to a second portion of said first wall, and a plurality of transversely extending steps overlapping at least a portion on said ribs of said second side wall projecting from the exterior portion of said second side wall; said upper pan having an elongated elliptical shape having two inclined end walls, a first and second inclined side wall, and a horizontally, centrally located bottom grid, said first and second inclined walls extending upwardly and outwardly from said bottom grid to a first height, said end walls extending obliquely upwardly and outwardly from said bottom grid to a second height, each said wall having an interior and exterior surface with a plurality of longitudinal axis perpendicular support members projecting from the exterior surface of each of said walls, wherein said upper pan is operatively associated with said lower pan by said support members of said upper pan maintaining said upper and lower pan in a predetermined position.

2. The apparatus according to claim 1, wherein said plurality of steps equals the number of ridges.

3. The apparatus according to claim 2, wherein said number of ridges comprises a lower ridge, a middle ridge, and an upper ridge.

4. The apparatus according to claim 3, wherein said ridges comprises frontal surfaces that are perpendicular to said bottom pan wall.

5. The apparatus according to claim 3, wherein the frontal surface of said lower ridge is approximately half that of the frontal surface of said middle ridge and the frontal surface of said middle ridge is approximately the same size as the frontal surface of upper ridge.

6. The apparatus according to claim 3, wherein said lower ridge is approximately half the size of said middle ridge and said middle ridge is approximately the same size as said upper ridge.

7. The apparatus according to claim 3, wherein said steps are operatively associated with said ridges.

8. The apparatus according to claim 7, wherein said steps include frontal surfaces that are perpendicular to said first side wall.

9. The apparatus according to claim 1, wherein said grid is formed from a concave cross hatched screen.

10. The apparatus according to claim 9, wherein said cross hatched screen comprises parallel raised ridges.

11. The apparatus according to claim 9, wherein said cross hatched screen is further defined as having tapered ridges comprised of an upper portion and a lower portion, said upper portion having a larger width than said lower portion.

12. A gold pan for separating particulate matter of disparate specific gravities from a carrier fluid comprising; an elliptically-shaped pan having two inclined end walls, a first and second pan inclined side wall, and a horizontally, centrally located bottom wall, said first and second inclined walls extending upwardly and outwardly from said bottom wall to a first height, said end walls extending upwardly and outwardly from said bottom wall to a second height, each said wall having an interior and exterior surface, a plurality of transversely extending ridges projecting from the interior surface of a first portion of said first side wall and encompassing said second side wall and both ends to a second portion of said first wall.

13. The gold pan according to claim 12, further comprising a plurality of transversely extending steps overlapping at least a portion on said ribs of said second side wall and projecting therefrom.

14. The apparatus according to claim 13, wherein said ridges comprise frontal surfaces that are perpendicular to said bottom pan wall; said ridges comprising a lower ridge, a middle ridge, and an upper ridge; the frontal surface of said lower ridge being approximately half the size as the frontal surface of said middle ridge and the frontal surface of said middle ridge being approximately of the same size as the frontal surface of upper ridge; said steps comprising frontal surfaces that are perpendicular to said first side wall.

15. A classifier unit for use with a gold pan for separating particulate matter of disparate specific gravities from a carrier fluid comprising; a filtration pan having an elongated elliptical shape having two inclined end walls, a first and second inclined side wall, and a horizontally, centrally located bottom grid, said first and second inclined walls extending upwardly and outwardly from said bottom grid to a first height, said end walls extending obliquely upwardly and outwardly from said bottom grid to a second height, each said wall having an interior and exterior surface with a plurality of support members projecting from the exterior surface of each of said walls, wherein said upper pan is operatively associated with a lower pan by said support members of said upper pan maintaining the upper and lower pan in a predetermined position.

16. The classifier unit according to claim 15, wherein said grid is formed from a concave-shaped cross hatched screen and comprises a first series of parallel raised ridges and a second series of parallel recessed ridges, said first series extending substantially perpendicular to said second series.

17. The classifier unit according to claim 15, in combination with a lower gold pan; said lower gold pan having a similar elliptical shape as said classifier unit, and an upper rim; said support members projecting from the exterior surface of said walls being supported by said upper rim of said lower gold pan.

18. The classifier unit according to claim 17, wherein said lower gold pan having a plurality of transversely extending ridges projecting from the interior surface of a first portion of said first side wall and encompassing said second side wall and both ends to a second portion of said first wall.

19. The classifier unit according to claim 18, wherein said gold pan further comprises a plurality of steps overlapping at least a portion on said ribs of said second side wall and projecting therefrom.

20. The classifier unit according to claim 19, wherein said ridges comprise frontal surfaces that are perpendicular to said bottom pan wall; said ridges comprising a lower ridge, a middle ridge, and an upper ridge; the frontal surface of said lower ridge being approximately half the size as the frontal surface of said middle ridge and the frontal surface of said middle ridge being approximately the same size as the frontal surface of upper ridge; said steps comprising frontal surfaces that are perpendicular to said first side wall.

* * * * *